US005112395A

United States Patent [19]

Ngo

[11] Patent Number: 5,112,395

[45] Date of Patent: May 12, 1992

[54] COMPOSITIONS AND PROCESS FOR METAL TREATMENT

[75] Inventor: Toan M. Ngo, Eureka, Mo.

[73] Assignee: Monsanto Company, St. Louis, Mo.

[21] Appl. No.: 674,260

[22] Filed: Mar. 25, 1991

Related U.S. Application Data

[62] Division of Ser. No. 313,768, Feb. 22, 1989, Pat. No. 5,026,423.

[51] Int. Cl.[5] ..... C23F 11/167

[52] U.S. Cl. ..... 106/14.12; 148/247; 148/254

[58] Field of Search ..... 106/14.12; 148/247, 148/254

[56] References Cited

U.S. PATENT DOCUMENTS

| | | | |
|---|---|---|---|
| 2,310,239 | 2/1943 | Jernstedt | 148/254 |
| 2,456,947 | 12/1948 | Jernstedt | 148/6.15 |
| 2,462,196 | 2/1949 | Jernstedt | 148/254 |
| 2,490,062 | 12/1949 | Jernstedt | 148/254 |
| 2,864,732 | 2/1968 | Miller | 148/254 |
| 3,741,747 | 1/1973 | Hamilton | 148/254 |
| 3,864,139 | 2/1975 | Heller | 106/1 |
| 4,063,969 | 12/1977 | Howell | 148/254 |
| 4,152,176 | 5/1979 | Guhde | 148/254 |
| 4,497,667 | 2/1985 | Yashi | 148/254 |
| 4,539,051 | 9/1985 | Hacias | 148/254 |
| 4,623,526 | 11/1986 | Leen | 423/277 |

FOREIGN PATENT DOCUMENTS

| | | | |
|---|---|---|---|
| 056675 | 7/1982 | European Pat. Off. | 148/254 |
| 825670 | 4/1981 | U.S.S.R. | 148/254 |

*Primary Examiner*—William R. Dixon, Jr.
*Assistant Examiner*—Anthony J. Green
*Attorney, Agent, or Firm*—R. C. Loyer

[57] ABSTRACT

Compositions and process for activating metal surfaces prior to coating with zinc phosphate are disclosed. A Jernstedt salt concentrate is provided which can be employed to prepare Jernstedt salt baths of the type desired by combining the concentrate with additional alkali metal phosphate. Improved activation of metal surfaces are achieved by incorporating a chloride ion producing compound in the activating bath.

12 Claims, No Drawings

COMPOSITIONS AND PROCESS FOR METAL TREATMENT

This is a DIVISION of Application Ser. No. 07/313,768, filed Feb. 22, 1989 U.S. Pat. No. 5,026,423.

This invention relates to compositions and processes for metal treatment utilizing such compositions. More particularly, novel titanium containing compositions are provided which are useful for the treatment of ferrous metals prior to applying protective coatings such as zinc phosphate and chrome.

The art of forming protective layers on ferrous metals has been the subject of investigation for many years. It has long been known to apply coatings to metal, particularly to ferrous metals, for the purpose of inhibiting corrosion. Paint materials as protective coatings are common and it is known that by improving the adhesion of paint to the metal more durable protection is provided by the paint.

In efforts to provide improved adhesion of paint layers on ferrous metals it was discovered that a thin layer of zinc phosphate directly on the metal greatly increased the ability of paint to adhere as well as inhibit corrosion.

The phosphating art greatly improved when it was discovered that ferrous metal surfaces treated or contacted with a solution containing a small amount of titanium together with sodium phosphate prior to zinc phosphating provided a zinc phosphate layer on the metal which was more evenly distributed and in smaller particle size. This discovery was made by G. W. Jernstedt who was awarded several patents in the area including U.S. Pat. Nos. 2,310,239; 2,456,947; 2,462,196 and 2,490,062. It is believed that the solution of sodium phosphate and titanium "activate" the metal such that the metal is more readily coated with zinc phosphate in the following step. The titanium containing materials or activating compositions became known as "Jernstedt salts".

Typically, Jernstedt salts are prepared by first dissolving disodium phosphate in water and adding titanium as a soluble salt. The aqueous solution is heated within a limited temperature range of from about 60° C. to about 85° C. with mixing for about 10 hours. The solution is then evaporated to dryness at elevated temperatures and the dry material is used to prepare aqueous solutions for metal pretreatment. It is known that the temperature to which the initial titanium of sodium phosphate solution is heated prior to evaporation is critical. Such temperature can be varied within only narrow limits as higher temperatures result in degraded product and lower temperatures result in inactive product.

Because of the sensitivity of Jernstedt salts with respect to the temperature range employed in their preparation, attempts have been made to eliminate the need for any heat to form the dry solid activating compositions. One other reason for attempting to eliminate the heating step is to conserve energy. One attempt in reducing the requirement for heat in the preparation of Jernstedt salts is shown in U.S. Pat. No. 4,152,176 to Guhde. This patent describes a method for preparing a Jernstedt salt, which includes sodium tripolyphosphate as a cleaner for the metal, by the steps of preparing a mixture of water, sodium tripolyphosphate, disodium phosphate and a titanium-containing compound. This aqueous mixture is heated to a temperature of from 65° C. to about 95° C. and the solution is then added to solid disodium phosphate with mixing to obtain a solid titanium phosphate composition. The solid composition is then employed to prepare solutions for treating metal surfaces prior to aqueous phosphating in the typical manner. Although the final mixture with disodium phosphate is considered to provide a dry activating composition such compositions contain about 15% water. Such mixtures are then employed to prepare Jernstedt salt solutions in the usual manner.

Further attempts to improve upon Jernstedt salts is shown in U.S. Pat. No. 4,539,051 to Hacias. In the aforementioned patent the Jernstedt salt contains tetrasodium pyrophosphate in addition to the small amount of titanium and a sodium phosphate compound. It is claimed that by including the pyrosphosphate, comparatively smaller amounts of the dry particulate salt are required in aqueous metal treating solution to activate the metal and thus provide superior phosphate coating.

The aqueous treatment bath temperature at which a metal surface is to be effectively treated has been known to be in the range of from about 49° C. to about 64° C. for one step cleaning and conditioning or activating. In an effort to reduce the required temperature of the bath, multi-component baths have been disclosed wherein the basic Jernstedt salt solution is employed together with other ingredients which perform adequate metal conditioning prior to the phosphating process. One such disclosure is found in U.S. Pat. No. 4,497,667 to Vashi. According to this patent the aqueous bath temperature is lowered to about 38° C. while obtaining adequate conditioning. Surfactants, sequestrants, buffers such as alkali metal carbonates, silicates and other ingredients are employed to achieve the desired result.

In all of the known preparations of Jernstedt salts it is the conventional wisdom to incorporate in aqueous solution a titanium salt having some solubility in water together and a sodium phosphate compound followed by heating these ingredients together at a temperature within a narrow range. In most instances the aqueous solution is evaporated to dryness requiring close attention to avoid an inferior product.

SUMMARY OF THE INVENTION

The present invention provides novel compositions and methods for preparing Jernstedt salt concentrates useful as activating agents in protective metal coating processes. The novel compositions are prepared by the steps of (a) preparing an aqueous solution comprising a water soluble titanium compound and a solubilizing amount of an alkali metal base, (b) combining the solution with a particulate alkali metal phosphate salt compound and c) heating the combination of (b) to remove free water at a temperature in the range of from about 60° C. up to a temperature which is below the deactivating temperature of the titanium.

The dry mixture forms a Jernstedt salt concentrate that is blended with additional alkali metal phosphate salt by means of dry mixing when desired to complete the formation of a typical Jernstedt salt. Alternatively, the concentrate may be added to the metal pretreating bath and additional alkali metal phosphate salt also added directly to the metal pretreating bath. The additional phosphate salt combined with the concentrate prepared as described above reduces the titanium concentration to the usual range for a Jernstedt salt, i.e.

from about 0.005% up to about 10% by weight of the mixture.

There has been provided in accordance with this invention a novel method of preparing a Jernstedt salt having the advantages of economy and convenience. The titanium compound is prepared in solution in the absence of any alkali metal phosphate salt. A concentrate is formed by combining the titanium solution with only a fraction of the alkali metal phosphate salt needed to form a typical Jernstedt salt thus lowering the amount of material brought to dryness at elevated temperature.

A further advantage of the composition and process of this invention is the economy achieved by shipping and storing a concentrate thereby allowing for completion of the Jernstedt salt at or near the point of need.

An optional ingredient, a halide ion producing compound, has been found to be highly advantageous in metal treating baths of this invention. A small amount of such halide ion producing compound, preferably sodium chloride, enhances the metal activating quality of the composition of this invention. Suitable phosphates include the primary, secondary and tertiary alkali metal salts of orthophosphoric acid and mixtures thereof. The preferred salt is disodium phosphate and, as will be shown below, disodium phosphate, anhydrous.

DETAILED DESCRIPTION OF THE INVENTION

The Jernstedt salt concentrate of this invention is prepared by dissolving in water an appropriate amount of titanium salt. Any suitable titanium salt can be employed which will dissolve in water sufficiently to provide the desired amount of titanium in solution. Any amount of titanium compound found convenient can be employed to prepare the initial aqueous solution. In general, the titanium cation concentration in solution is from about 0.5% to about 25% by weight as the titanium ion. Liquid forms of titanium such as titanium tetrachloride may be employed directly for addition to the alkali metal phosphate salt but such form of titanium is highly inconvenient.

Typically, previously known titanium salts employed to prepare Jernstedt salts can be employed herein and include titanium oxalate, titanium halides, and preferably titanium sulfate Titanium halides include the chloride and fluoride salt. In one preferred embodiment of this invention a titanium sulfate salt ($TiSO_4 \bullet H_2SO_4 \bullet 8H_2O$) is employed. Other titanium halides include $TiBr_3 \bullet 6H_2O$, $TiBr_4$, $TiF_4$, $TiF_3$, $TiI_2$, $TiI_4$.

In the process of this invention wherein a Jernstedt salt concentrate is prepared there is desirably combined with the titanium compound in water solution a trace amount of a halide ion producing compound preferably a chloride ion producing compound. It has been found that when incorporated into the concentrates of this invention the activation achieved for purposes of further treatment with zinc phosphate is greatly enhanced Any number of chloride ion producing compounds can be employed in the compositions and processes of this invention which do not unfavorably react with the other components of the Jernstedt salt concentrate or prevent ultimate phosphate coating of the metal. The most commonly available compound which provides the chloride ion is the alkali metal chlorides and preferably sodium chloride. Other chloride ion producing compounds useful in preparing the Jernstedt salt concentrate compositions of this invention are $POCl_3$, $PCl_3$, $PCl_5$, HCl, NaOCl, KOCl, HOCl, $ZnCl_2$, $CaCl_2$, $MgCl_2$, $SnCl_2$, $NaClO_3$, $NaClO_4$, and the like.

The chloride ion concentration, as mentioned above, is in trace amounts in the compositions of this invention. Sufficient chloride ion is provided by amounts as little as in the range of from about 0.001 moles to 0.02 moles of the chloride ion producing compound in the metal treating bath containing a Jernstedt salt. This small amount is incorporated together with the titanium compound in aqueous solution. Therefore, the chloride ion producing compound is desirably water soluble at least to some extent. Water solubility is not critical since such a small amount of material is required in solution. Expressed as weight percent of the solution the chloride producing compound is desirably present in an amount of from about 0.5% to about 6% and preferably in the range of from about 0.5% to about 2.5% although amounts up to about 4% have been found to be advantageous.

To reduce the amount of time required to dissolve the titanium compound in aqueous solution, it has been found desirable to add a small amount of an alkali metal base, preferably sodium carbonate to the aqueous mixture containing the titanium compound. It has been found that with the addition of very small amounts of alkali metal base such as the oxide, hydroxide or preferably carbonate enables the titanium compound to dissolve at a much faster rate. The amount of alkali metal base is not critical but a minimum amount to alter the solubility characteristics of the titanium compound is in the range of from about 1% to about 8% by weight of the aqueous mixture. Preferably the alkali metal base concentration is from about 2% to 6% by weight of the solution. Larger amounts of the alkali metal base may be employed but the effect on solution rate is not appreciable. Alkali metal bases such as sodium potassium and lithium can be employed.

Typically, the titanium compound is brought into solution in warm deionized water together with the chloride producing compound and alkali metal carbonate. Slight heating may be required to further aid the rate of solution of the titanium compound. Such heating is not critical to the operability of the final Jernstedt salt with respect to its ability to activate metal surfaces and is in clear contrast to the requirement of heating followed by evaporation to dryness required formerly in the preparation of Jernstedt salts. Typically, adequate rates of solution are obtained by heating the aqueous mixture to a temperature in the range of from about 40° C. to 70° C. and preferably in the range of from about 45° C. to about 55° C.

The solution containing the titanium compound, the optional chloride ion producing compound and alkali metal carbonate is then added preferably slowly to an alkali metal phosphate salt, preferably disodium phosphate dihydrate which is in the form of particulate material. The solution is thoroughly mixed with the salt to form a paste like or gelled composition. After thorough mixing to achieve uniform distribution of the titanium compound the mixture is dried slowly at a temperature in the range of from about 60° C. to about 90° C. and preferably in the range of from about 75° C. to about 80° C. Drying the mixture at elevated temperatures is known to deactivate the titanium ions for the purpose of pretreatment in the phosphating process for metal surfaces. Such deactivating temperatures are regarded to be in excess of about 95° C. Drying will, of course, depend upon the apparatus employed, the uniformity of the application of heat and other other mechanical factors. The dried product may contain small amounts of water of hydration. However, free water is substantially removed by the heating step.

The titanium solution is usually combined with the alkali metal phosphate salt in a ratio such as to provide up to about one-half or more of the total amount of alkali metal phosphate salt normally employed to prepare the Jernstedt salt. Lesser amounts of alkali metal phosphate salt may be employed. It is preferred to combine the solution of titanium with from about 20% to about 40%, by weight, of the total amount of alkali metal phosphate to be used in metal treatment solutions because the resulting titanium solution paste or gel-like product is easily mixed to assure uniformity of the resulting Jernstedt salt concentrate. By employing only a fraction of the total amount of phosphate salt it can be easily seen that the drying step is more efficient because of the smaller amount of material requiring drying. Further, the amount of liquid required to dissolve the titanium compound compared to the amount of sodium phosphate compound is very small thereby providing much less liquid which requires removal to obtain the dry, particulate Jernstedt salt concentrate of this invention. Typically, the ratio of water carrying the dissolved titanium compound into contact with the alkali metal phosphate salt is in the range of from about 1:3 to about 1:7, by weight. The phosphate salt is therefore only moistened to a small degree and the drying operation accordingly reduced.

In an alternative embodiment of this invention the titanium solution (a) above can be mixed with the total requirement of alkali metal phosphate salt thereby making a directly useful Jernstedt salt after drying as described in step (c) above. In this instance the usual concentration of titanium ion well known in the art is provided by combining sufficient alkali metal phosphate salt, i.e., a concentration usually in the range of from 0.1% to about 1% by weight.

The dried mixture containing the titanium and chloride ion forming compound is broken up into fine particulate material after the heating step to assure uniformity and if necessary the dried material is comminuted to the desired size The dried material can then be employed to prepare an effective Jernstedt salt by combining it with further alkali metal phosphate salt. Typically, the Jernstedt salt concentrate of this invention can be added to water and additional amounts of the alkali metal phosphate salt added thereto thus forming the typical Jernstedt salt in situ. Alternatively, the additional alkali metal phosphate salt can be dry mixed with the concentrate prepared as described above to provide the typical Jernstedt salt having the percentage compositions normally employed in the metal treating processes known in the prior art. Although the amounts of ingredients are within the control of the user it is typical to employ about one-fourth of the usually required alkali metal phosphate salt in preparing the concentrate and supplying the remainder of the phosphate salt either in a dry mix or in aqueous solution as described above.

As mentioned above, the relative amounts of ingredients used in the preparation of the concentrate can be adjusted over a wide range but are chosen to provide an easily measurable amount of ingredients in preparing the concentrate and the final usable activating Jernstedt salt or solution employed in the metal treating process.

As an example of a preferred embodiment of the invention 15 grams of titanium sulfate ($TiOSO_4 \bullet H_2SO_4 \bullet H_2O$) were dissolved in 20 ml of warm deionized water at a temperature in the range of from about 45° C. to about 55° C. To the deionized water were previously added 0.99 grams of sodium carbonate and 0.54 grams of sodium chloride. When a clear solution was obtained (in about 35 minutes) the solution was added slowly to 87.75 grams of dry disodium phosphate dihydrate. During the addition of the liquid to the solid disodium phosphate dihydrate the mixture was agitated manually by means of a mortar and pestal. The mixture was then heated slowly at a temperature in the range of from 45° C. to about 55° C. for 15 minutes while mixing continued. There was produced a gel-like paste which was then dried in an oven at a temperature in the range of between 70° C. and 80° C. for about 2 hours to form a dry particulate mixture. To form a Jernstedt salt 0.37 grams of the above-described dry mixture and 1.43 grams of anhydrous disodium phosphate were dissolved in 1.8 liters of deionized water to provide a solution having a pH of about 8.4. The solution, at room temperature or about 23° C., was employed to activate a cleaned ferrous metal surface by dipping the metal into the solution for about 30–45 seconds. After removal of the metal from the activating bath the metal was coated with zinc phosphate in the typical known manner. Good results were achieved in the zinc phosphate coating operation.

In another preferred embodiment the Jernstedt salt concentrate was prepared as described above with the exception that only 60 grams of disodium phosphate anhydrous was employed to prepare the gel-like paste and in the preparation of the pretreatment activating bath 0.5 grams of the concentrate was employed with 1.3 grams of anhydrous disodium phosphate in 1.8 liters of deionized water to provide a solution having a pH equal to 8.23. Excellent results were achieved by the use of both concentrate in activating a ferrous metal surface by dipping the metal into an activating bath followed by the zinc phosphate treatment in accordance with prior art procedures.

The titanium-containing phosphate compositions prepared in accordance with the process of this invention are useful in cleaning and activating the surfaces of ferrous, zinc cadmium or aluminum metals and alloys thereof wherein said metals or alloys form the predominant constituent particularly for subsequent reaction with phosphate coating solutions. In preparation of aqueous solutions for activating metal surfaces for subsequent treatment in a zinc phosphate coating process the dried concentrate of this invention is dispersed in water to produce an aqueous pretreatment solution having a concentration of titanium ions ranging from about 0.0001% up to about 1% by weight. Because of the small amount of titanium ion in the treating solution it may be convenient to premix the concentrate of this invention with the total amount of alkali metal phosphate salt in the dry state such that the amount being measured into the treating bath may be performed less tediously. However, with the concentrates of this invention it can be seen that much smaller amounts of the salts may be shipped and stored by creating the completed Jernstedt salt at the point of need rather than forming it at a location remote from the point of need.

While this invention has been described with reference to the novel Jernstedt salt concentrates and their utility it is apparent that the Jernstedt salt solution employed to treat metals may contain other additives such as adjuvants, cleaning agents and surfactants. If desired, dry particulate adjuvants, cleaning agents or surfactants may be incorporated into the Jernstedt salt concentrates of this invention such that when added to the treating bath the only other required ingredient for a complete treating bath would be the alkali metal phosphate salt.

While it is apparent that the preferred embodiments of the invention disclosed are well calculated to fulfill the objectives of the present invention, it will be appreciated that the invention is capable of modification, variation and change without departing from the scope or fair meaning of the following claims.

What is claimed is:

1. A process for preparing a particulate Jernstedt salt concentrate for use in producing protective phosphate coatings on metal surfaces by admixture with water comprising:

(a). preparing an aqueous solution of a water soluble titanium ion producing compound and heating said solution to a temperature above about 60° C. and below the deactivating temperature of said titanium ion;

(b). combining said solution with an alkali metal phosphate salt selected from the group consisting of primary, secondary and tertiary salts of orthophosphoric acid and mixtures thereof to form a product;

(c). drying the product of step (b) to remove free water to form a dried product; and (d). combining the dried product of step (c) with additional amounts of said alkali metal phosphate salt wherein the product of step (b) contains from about 20% to about 40%, by weight, of the total amount of alkali metal phosphate salt in said concentrate.

2. A process of claim 1 further including an alkali metal base which is introduced in step (a).

3. A process of claim 2 wherein the alkali metal base is selected from the oxide, hydroxide or carbonate.

4. A process of claim 2 wherein the alkali metal base is present in the range of from about 1 percent to about 8 percent by weight of the aqueous solution.

5. A process of claim 2 wherein the alkali metal base is sodium carbonate.

6. A process of claim 1 wherein the alkali metal phosphate is disodium phosphate.

7. A process of claim 1 wherein the titanium ion producing compound is selected from the group consisting of titanium tetrachloride, titanium trichloride, titanium hydroxide, titanium potassium oxalate, titanium sulfate, titanium dioxide, titanium potassium chloride, $TiBr_3 \bullet 6H_2O$, $TiBr_4$, $TiF_4$, $TiI_2$, and $TiI_4$.

8. A process of claim 7 wherein the titanium compound is titanium sulfate which is present in an amount in the range of from about 1 percent to about 6 percent by weight of the solution.

9. A process as in any one of the preceding claims further including a trace amount of a chloride ion producing compound which is introduced into step (a).

10. A process of claim 9 wherein the chloride ion producing compound is present in the range of from about 0.5 percent to about 6 percent by weight of the solution.

11. A process of claim 9 wherein the chloride producing compound is sodium chloride present in the range of from about 0.5 percent to about 2.5 percent by weight of the solution.

12. A process of claim 1 wherein the solution of step (a) contains from about 0.5% to about 25%, by weight, titanium ion.

* * * * *